US007467881B2

(12) United States Patent
McMillen

(10) Patent No.: US 7,467,881 B2
(45) Date of Patent: Dec. 23, 2008

(54) MULTI-PURPOSE LAMP HOUSING AND NETWORK

(76) Inventor: Kenneth Clark McMillen, 22392 Canaveras, Mission Viejo, CA (US) 92691

( * ) Notice: Subject to any disclaimer, the term of this patent is extended or adjusted under 35 U.S.C. 154(b) by 0 days.

(21) Appl. No.: 11/708,389

(22) Filed: Feb. 20, 2007

(65) Prior Publication Data

US 2008/0198583 A1 Aug. 21, 2008

(51) Int. Cl.

| | |
|---|---|
| ***F21V 17/00*** | (2006.01) |
| ***F21V 23/04*** | (2006.01) |
| ***F21V 33/00*** | (2006.01) |
| ***F21S 8/02*** | (2006.01) |

(52) U.S. Cl. ..... 362/364; 362/147; 362/276; 362/253

(58) Field of Classification Search ..... 362/147, 362/148, 150, 364, 365, 253, 458, 276, 85, 362/86, 366, 260

See application file for complete search history.

(56) References Cited

U.S. PATENT DOCUMENTS

| | | | | |
|---|---|---|---|---|
| 4,090,178 | A | 5/1978 | Norris | |
| 4,694,285 | A | 9/1987 | Scripps | |
| 4,717,910 | A * | 1/1988 | Scripps et al. | 340/693.1 |
| 4,812,827 | A | 3/1989 | Scripps | |
| 4,896,145 | A | 1/1990 | Lewkowicz | |
| 4,980,672 | A | 12/1990 | Murphy | |
| 5,649,761 | A | 7/1997 | Sandell et al. | |
| 5,980,057 | A * | 11/1999 | Christie | 362/86 |
| 6,095,660 | A | 8/2000 | Moriyama et al. | |
| 6,095,669 | A * | 8/2000 | Cho | 362/365 |
| 6,948,831 | B1 * | 9/2005 | Naqvi | 362/276 |
| 6,960,892 | B2 | 11/2005 | Loughrey | |
| 2003/0222587 | A1 * | 12/2003 | Dowling et al. | 315/149 |
| 2006/0176697 | A1 | 8/2006 | Arruda | |
| 2007/0069882 | A1 * | 3/2007 | Mahajan | 340/500 |

* cited by examiner

*Primary Examiner*—Jong-Suk (James) Lee
*Assistant Examiner*—David R Crowe
(74) *Attorney, Agent, or Firm*—Gene Scott; Patent Law & Venture Group

(57) ABSTRACT

A multipurpose ceiling fixture selectively receives and powers multiple components. A mounting strap supports a lamp socket, a battery socket, and plural power outlets for selected components. A cylindrical lamp housing within the fixture is attached to the mounting strap and a lamp is engaged with the lamp socket. An annular mounting chassis is adapted for receiving a plurality of the components which may include a loudspeaker; detectors of particles, heat, motion, sound and noxious gas; an audible alarm; a video cam; and an intercom. One may select only those components that are of interest to a particular installation and then can install such components into power sockets and on one or another of the several mounting surfaces. Of particular advantage is a mounting chassis that allows components a line of sight lateral to the fixture.

3 Claims, 3 Drawing Sheets

MULTI-PURPOSE LAMP HOUSING AND NETWORK

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

REFERENCE TO A "MICROFICHE APPENDIX"

Not applicable.

BACKGROUND OF THE INVENTION

1. Field of the Present Disclosure

This disclosure relates generally to lamp fixtures and more particularly to such a fixture concurrently adapted for providing a wide range of services beside illumination, such as noxious gas, smoke, heat, and motion detection, music, voice and sound emissions, alarming, video reception and intercom service.

2. Description of Related Art Including Information Disclosed Under 37 CFR 1.97 and 1.98

Arruda, U.S. 2006/0176697, discloses a combination light fixture and motion sensor apparatus contained in a single enclosure, which turns on automatically when approached and which turns off automatically when the area is vacated. In particular, this apparatus is one that can be mounted in a closet, pantry, cabinet, under a cabinet, or an area where wiring a separate light and switch is not feasible or practicable. The combination light fixture and motion sensor apparatus is contained within a single enclosure, and the apparatus may be mounted inside a closet and above the closet door. By being mounted above the door, the motion from the door being opened triggers the motion sensor so that the light will come on automatically. The apparatus also turns off the light automatically when not needed, so as to save energy.

Norris, U.S. Pat. No. 4,090,178, discloses a structure for combining, at one location, smoke detection circuitry and wall or ceiling lamp apparatus. The structure includes a housing formed with a bottom wall and side walls and having an opening at the top thereof. The bottom wall has an opening centrally located therein. Also included is a lamp socket disposed in the housing so that the socket opening may receive the base of a lamp bulb through the opening in the bottom wall. Smoke detection circuitry is also disposed in the housing about the lamp socket. The circuitry includes an audible sound producing mechanism and a detector element responsive to the presence of smoke thereat for causing the sound producing mechanism to produce audible sound. The circuitry is powered alternatively by a rechargeable battery or by the current supplied to the lamp bulb.

Scripps, U.S. Pat. No. 4,694,285, discloses a combination electrical smoke, heat detector and electrical light in a single unit which is removably attachable to an electrical fixture. The combination includes a closed housing containing smoke heat sensing alarms. Also recessed flush within the housing is a light bulb socket for reception of a light bulb into a face of the housing. Protruding from an opposite face of the housing is an electrical connector, capable of screw-in attachment to a standard electrical outlet fixture. A switching device to turn the light on or off, forms of which include: push button, toggle switch, or pull chain, is installed within the closed housing such that the switch is operable externally of the housing. A second switching device, also operable externally of the housing activates and de-activates a self-contained battery power source to operate the smoke and heat sensor functions of the combination.

Scripts et al., U.S. Pat. No. 4,717,910, discloses a detector and light assembly combining an electrically powered detector and alarm and an electrical light into a single unit which is removably attachable to a conventional light socket. The unit includes a closed housing containing a detector and alarm system and a control circuit. Also recessed flush within the housing is a light bulb socket for reception of a light bulb into a face of the housing, and protruding from an opposite face of the housing is an electrical connector capable of screw-in attachment to a standard socket. The control circuit operates in response to activation of the alarm system to cause a light bulb in the light bulb socket to flash off and on. Otherwise, illumination of the bulb is controlled by a manual switch installed within the housing such that the switch is operable from outside the housing.

Scripps, U.S. Pat. No. 4,812,827, discloses a detector assembly that combines an electrically powered detector and alarm and an electrical light into a single unit which is removably attachable to a conventional electrical receptacle. The unit includes a closed housing containing a detector and alarm system, and recessed within the housing is a light bulb socket for reception of a light bulb into a face of the housing. Protruding from an opposite face of the housing is an electrical connector capable of removable attachment to a standard electrical receptacle. A sound transmitter in the housing may transmit audible alarm signals to a remote receiver, which may be mounted in another detector assembly at a remote location to cause this detector assembly to emit alarm signals.

Lewkowicz, U.S. Pat. No. 4,896,145, discloses a combined light and fire detector fixture mountable on a recessed electrical box having a housing, mounting means to mount the housing to the electrical box, a light fixture having lamp holding means, mounting means for mounting the light fixture to the housing and electrical conducting means for coupling the lamp holding means to a switch and an alternating current power source, and fire detecting means including smoke or heat sensing elements and being mounted to the outside of the housing to provide easy access thereto and to decrease the heat generated within the housing and electrical box.

Murphy, U.S. Pat. No. 4,980,672, discloses an overhead socket smoke detector with a theft alarm that includes a case with a bulb base at one end and a lamp socket at an opposite end and connected to the bulb base by a socket switch which is closed by a lamp received in the socket to electrically activate the socket. The case has a cylindrical diameter to fit within a can light fixture. Smoke alarm circuitry is mounted within the case and includes a smoke sensor circuit, a trigger circuit, and a sounder circuit. A unit removal or theft switch connected to the trigger circuit includes a switch operator extending through the bulb base to engage a socket into which the case is threaded. A rechargeable battery and a battery charger are connected between the bulb base and the alarm circuitry and provide power to operate the alarm circuitry. When the unit is removed from its fixture, the unit removal switch disengages the fixture socket and triggers the sounder circuit into activation to deter removal of the unit from the socket in which it is mounted.

Moriyama et al., U.S. Pat. No. 6,095,660, discloses a present invention that relates to a fixture to be mounted in a mounting hole in a ceiling or the like and an attachment device of the fixture, wherein the fixture is provided with an electrical connection means and a mechanical stopping means, the electrical connection means including a power supply port that can be connected by a simple operation, and the mechanical stopping means capable of removably fixing a heavy and elongated fixture in the mounting hole, so that, when the fixture is mounted in the mounting hole, both electrical and mechanical connection is simultaneously done. By an integrated design of the fixture wherein the back of the mounting hole (a space behind the ceiling panel or the like) is used as a housing space for a lighting circuit member, etc., the fixture can be made more compact with an improved design flexibility, and changes and movements of fixtures with respect to the mounting hole become possible.

Sandell et al., U.S. Pat. No. 5,649,761, discloses a light fixture controlled by a passive infrared motion detector including a base, one or more lamp holders attached to the base, and a detector housing also attached to the base and containing the motion detector. The lamp holders each comprise a socket housing for receiving a floodlight bulb or the like and a shade or reflector at the front of the socket housing. The lamp holder assembly is connected to the base by a support arm that is pivotally connected to a side wall of the socket housing offset from the end of the socket housing instead of being connected at the end of the socket housing as is conventional. The pivoting side mounting of the lamp holder permits the lamp holder to pivot with a moment arm that is significantly shorter than the overall length of the lamp holder. The shortened moment arm permits the motion detector housing to be mounted closer to the supporting base while leaving sufficient space for the lamp holders to swing through a wide range of movement without the risk of inducing false activations through interference with the movable motion detector housing.

Naqvi, U.S. Pat. No. 6,948,831, discloses a recessed lighting assembly that is adapted to be integrated with a motion detector subassembly, photoelectric cell, and an electronic timer. The motion detector subassembly includes motion detector sensor(s), a focusing device and a decorative shield over focusing device. Motion detector subassembly is generally disposed inside the decorative trim. The required conditions for allowing electrical power to reach said electric lamp are the presence of line electric current, detection by motion detector subassembly of infrared radiation attributable to human and/or animal presence, and a lack of ambient light as measured by said photoelectric cell. Said electronic timer controls the amount of time the electric lamp contained in said recessed lighting assembly is allowed to remain on once it is turned on. Such recessed light assembly is to be used for the purpose of providing convenience, savings on electricity consumption, and security of premises. Different embodiments of the Recessed Light Assembly are presented and these include the complete Recessed Light Assembly, a stripped down, Slidable Recessed Light Assembly, a Recessed Light Assembly Trim & Motion Detector Assembly, and a Recessed Light Assembly Trim with all electronics surface mounted and all circuits etched directly on the inside of the said trim.

Loughrey, U.S. Pat. No. 6,960,892, discloses a light fixture that has a variable light output level using one constant voltage power source that includes multiple individually computer controllable light sources. Multiple light fixtures may be networked and individually controlled. Additional accessory control devices, such as motion sensors, photo sensors, and time clocks, may be connected with the light fixture and networked.

The related art described above discloses illuminating devices which serve other purposes such as intrusion and vapor detection. However, the prior art fails to disclose a lamp with several, to many, built-in power outlets for attaching a plurality of detection and other apparatuses, and a mounting chassis within the rim of the apparatus enclosure that is able to mount a plurality of devices so that the apparatus may be easily modified or adapted to a wide variety of purposes and utilities. Further, the prior art fails to provide a mounting surface within the fixture that is able to provide device mounting while giving them a line of sight to "see" objects in lateral periphery to the fixture itself. The present disclosure distinguishes over the prior art in these ways, providing heretofore unknown advantages as described in the following summary.

BRIEF SUMMARY OF THE INVENTION

This disclosure teaches certain benefits in construction and use which give rise to the objectives described below.

The present invention is a multipurpose ceiling fixture which selectively receives and powers multiple components chosen by the user. A can structure for flush mounting in a ceiling provides within a mounting strap supporting a lamp socket, a battery socket, and plural power outlets for selected components. A cylindrical lamp housing within the can structure is attached to the mounting strap and a lamp is engaged with the lamp socket.cylindrical mounting chassis is adapted for receiving a plurality of the components which may include a loudspeaker; detectors of particles, heat, motion, sound and noxious gas; an audible alarm; a video cam; and an intercom. One may select only those components that are of interest to a particular installation and then can install such components into power sockets and on one or another of the several mounting surfaces. Of particular advantage is a mounting chassis that allows components a line of sight lateral to the fixture so that, for instance, video cam can capture those walking below the fixture, or a motion detector can sight motion a considerable distance from the fixture to alert an alarm.

Another objective is to provide a highly adaptable ceiling fixture capable of playing many different roles beside providing illumination.

Another objective is to provide a highly adaptable ceiling fixture capable of paying many different roles beside providing illumination.

A further objective is to provide a ceiling fixture that functions as a detector of intrusion and an alarm base beside providing illumination.

A further objective is to provide a ceiling fixture that functions as a detector of smoke and other noxious gas, vapor and fume, and an alarm base beside providing illumination.

A further objective is to provide a ceiling fixture that functions as a fire detector and an alarm base beside providing illumination.

A further objective is to provide a ceiling fixture that functions as a video security sentry beside providing illumination.

A further objective is to provide a ceiling fixture that functions as a source of background music beside providing illumination.

A further objective is to provide a ceiling fixture that functions as an intercom beside providing illumination.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Illustrated in the accompanying drawing(s) is at least one of the best mode embodiments of the present invention In such drawing(s):

DETAILED DESCRIPTION OF THE INVENTION

The above described drawing figures illustrate the described apparatus and its method of use in at least one of its preferred, best mode embodiment, which is further defined in detail in the following description. Those having ordinary skill in the art may be able to make alterations and modifications to what is described herein without departing from its spirit and scope. Therefore, it must be understood that what is illustrated is set forth only for the purposes of example and that it should not be taken as a limitation in the scope of the present apparatus and method of use.

Figure 1:
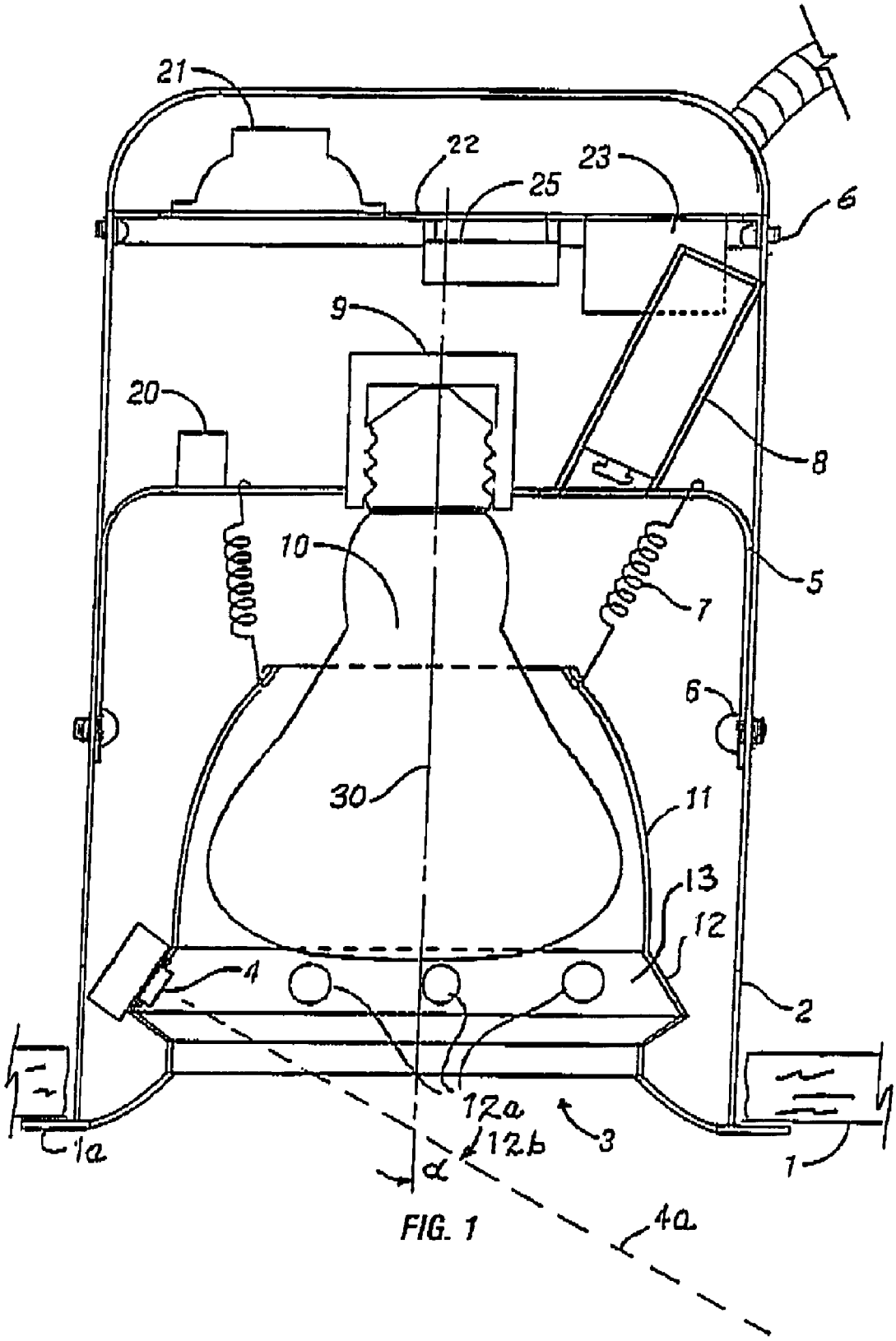
FIG. 1 is an elementary mechanical schematic showing a vertical cross sectional view of the present invention.

Described now, in detail, is a multipurpose thin sheet material, such as sheet metal, fabricated ceiling fixture adapted for selectively receiving and powering multiple components. In a preferred embodiment, the fixture is flush mounted in a ceiling 1 as shown in FIG. 1. The fixture preferably has a vertically oriented cylindrical can 2 providing a circular rim l*a* at a lower open end 3 of the can 2. A mounting strap 5 is removably fastened, preferably by screws 6 within the can 2, the mounting strap 5 supporting a lamp socket 9, a battery socket 8, and plural power outlets 20 for the components. A cylindrical lamp housing 11 within the can 2 depends downwardly from the mounting strap 5 preferably by coil springs 7. A lamp 10 is engaged with the lamp socket 9 thereby being positioned within the lamp housing 11.

Integral with, and extending downwardly from the lamp housing 11 is a cylindrical mounting chassis 12, as shown in FIG. 1. The mounting chassis 12 provides an annular mounting surface 13 positioned at an angle of between 35 and 55 degrees relative to the lower open end 3 of the can 2. The mounting surface 13 is adapted for receiving a plurality of the components especially detectors 4, for instance detectors of particles (smoke SD 1), heat (infrared sensor), motion (infrared sensor MS 1), sound (microphone) noxious gases (51); and a video cam. "The mounting chassis 12 having an annular mounting surface positioned at an angle a of between 35 and 55 degrees relative to a vertical axis 30 of the can in order to orient a line of sight of the components across the open end of the can".Detector 4 shown in FIG. 1 represents any one of these detectors or others as a user might decide to use. It is noted that detectors 4 also represents a video cam and it is seen that both a video cam and a motion detector when mounted on mounting surface 13 is able to sight advantageously along a line 4a that is directed across the lower open end 3 of the can 2 at an angle of between 35 and 55 degrees with respect to the horizontal, and lateral to the lower open end 3 of the can 2.

Figure 2:
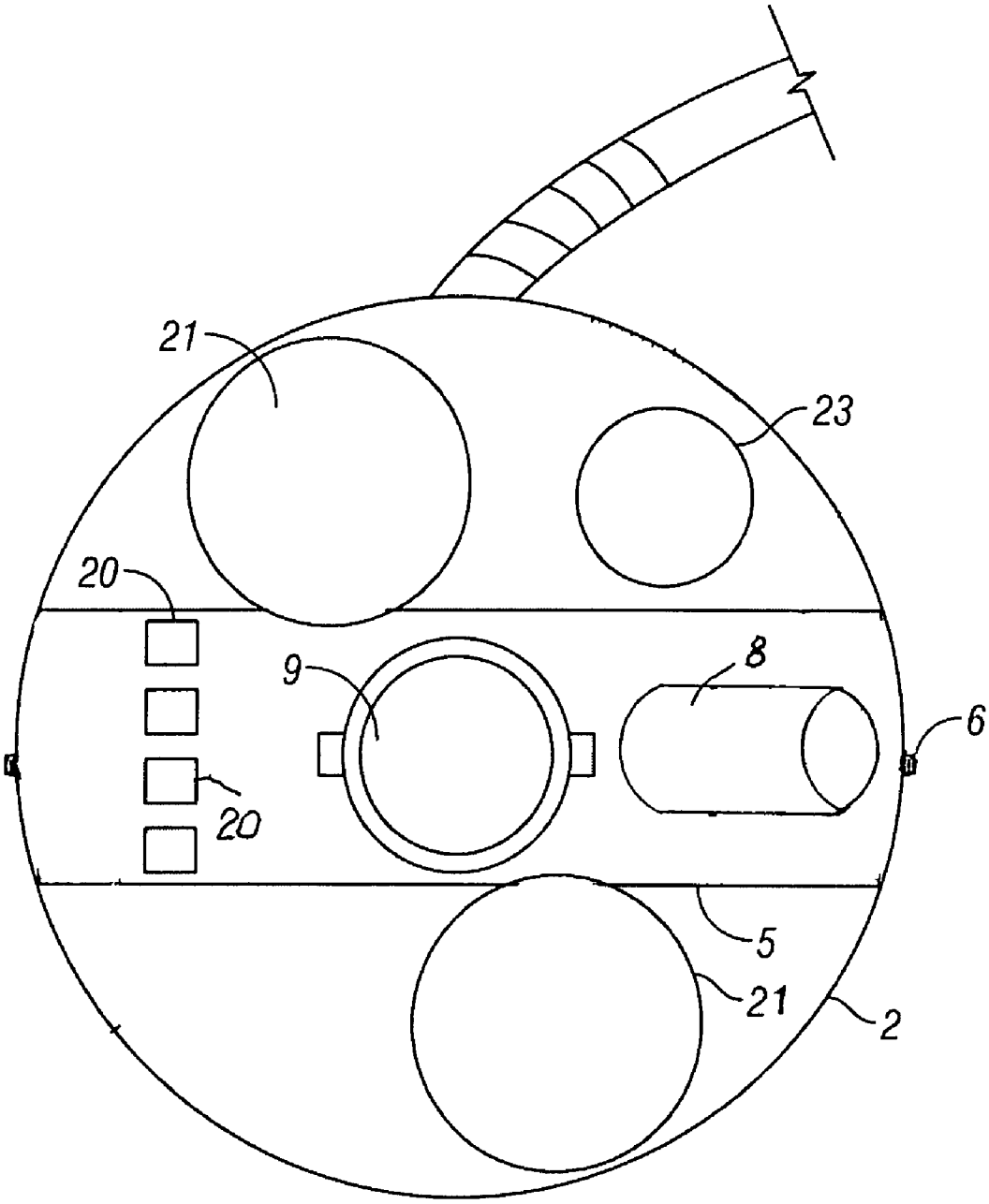
FIG. 2 is an elementary mechanical schematic showing a top plan view thereof.

Also preferably mounted in the ceiling fixture is an audible alarm device 23 such as a horn or other high decibel noise maker, an intercom 25, and one or more loudspeakers 21. These, and potentially other, components are preferably mounted on a shelf 22 removably fastened within the can 2, the shelf 22 providing mounting means for the selected components. It is noted that in FIG. 2 shelf 22 and intercom 25 are not shown so as to maintain clarity in the drawing.

Preferably, the mounting surface 13 is adapted with a plurality of knock-outs 12a. Each of the knock-outs 12*a*, when removed from the mounting surface 13, reveals a cutout 12*b* configured for receiving one of the components.

Preferably, the intercom 25 comprises an audio receiver, and an audio driver (FIG. 3); and intercom 25 is engaged with the loudspeaker 21 for producing music, voice and alarm sounds. Alarm noises may be emitted by both the speaker(s) 21 and the audible alarm device 23 after detection of smoke, gases, intruders and so on.

Clearly, the above described apparatus may be modified to perform many functions beside illumination. For instance, the ceiling fixture may detect undesired intrusion either by picking up sounds, or by detection of the movement of an intruder's heat signature as the intruder moves toward or away from the fixture, or by detecting pixel sensing changes in a video cam. These three types of intruder identification may be used concurrently, one relying on the others for confirmation, with alarm outputs triggered by a circuit requiring joint confirmation to avoid false alarms. Such a circuit would be easily designed by any electrical engineer.

The above described apparatus may also be modified to detect fire by the use of a smoke detector, a heat detector using infrared detection, or a noxious gases detector for sensing any selected type of liberated gaseous material including those in the form of vapors and fumes. Again, alarm outputs may be triggered by one or more of such detectors alone or together. The fact that a detector is able to "see" some lateral distance from the apparatus enables the apparatus to use infrared heat sensors beneficially since light fixtures are normally spaced apart for uniform light distribution, therefore IR sensors in each of the fixtures in a home are able to cover most of the living spaces when they are mounted in the lighting fixtures. The sensing of only smoke but no heat may indicate burning toast; not a general alarm condition, while the sensing of both smoke and heat most likely indicates a fire, cause for a general alarm condition. By using both smoke and heat detection, the present invention is a superior safety device for general use as a fire detector.

The above described apparatus is able to function as a video security sentry by mounting video cams in appropriate fixtures within a residential or commercial space. Since each video cam is mounted at the source of illumination, it is assured of maximum illumination on subjects of interest such as those walking below each fixture. A network of such video cams with their signals (wired or wireless) received by a centrally located monitoring screen or recorder, is a superior security setup for both looking in on children present in other portions of a residence, for instance, and for vacant premises intruder detection and identification with wireless alert signals received off-site.

The above described apparatus may also function as an improved: source of background music, as a public address system, a general warning annunciator, and has many other beneficial applications using audio. When all, or many of the lamp fixtures in a structure are fixed also with the intercom enablement described, a uniform dispersal of sound is provided without the typical large sound volume differentials normally associated with large speakers that are fixed at one position. This enablement is particularly useful in restaurants, playrooms, etc.

When the above described apparatus is used as an intercom, a microphone is included on the mounting surface 13 and is integrated with the audio components previously described to pickup voice signals and distribute them to selected locations within a building. Such selectivity of destination is easily accomplished by using a voice recognition device, well known in the art. For instance, such a recognition device might be easily trained by specific individuals to recognize a few simple terms such as: "backyard", "masterbedroom", "livingroom", "peggysroom", "general", and so on. As an example, when using the intercom feature, one would say aloud, "intercom" wherein the intercom system becomes active awaiting a location command. Next, the person speaking would say, "general", for example, to define a location where the loudspeakers 21 are to be activated, in this case all speakers are to be activated; and then make a statement or question such as, "Peggy, would you please come to dinner?" With at least one ceiling, wall or post mounted fixture as described herein, speech can be projected to all parts of a dwelling or its backyard, pool area, garden area, and so on, and it is possible to provide convenient discussions between persons at different locations. With the issuance of a final command such as "bye", the intercom will shut off. Such voice activated and operated devices are very well known in the art.

Figure 3:
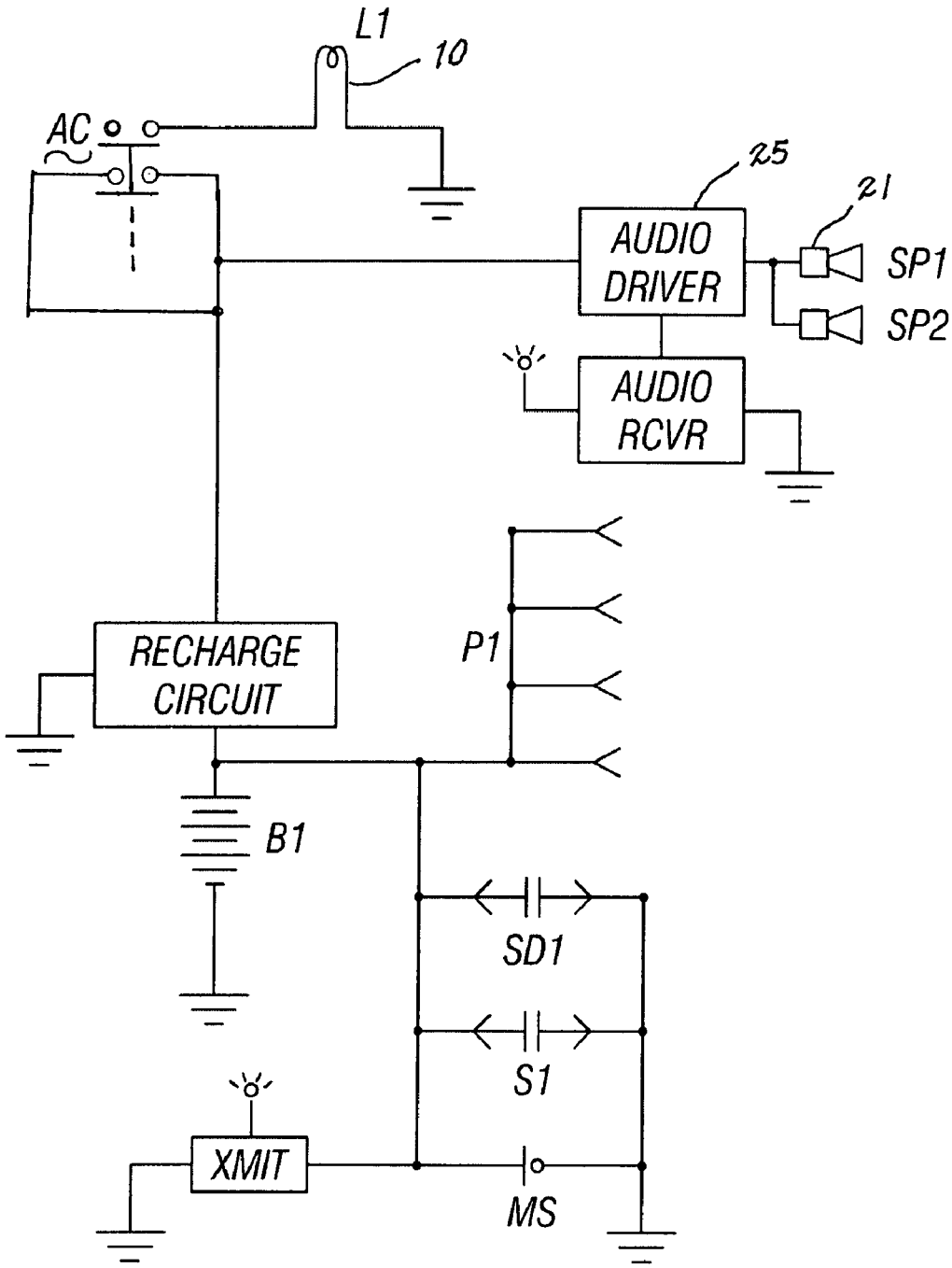
FIG. 3 is an electrical schematic diagram thereof.

It is clear that not all installations of the present invention will be directed to every application: intrusion, fire, fume detection, active vigilance, music, and intercom, but with the present invention, it is possible to do so. The novelty of the present invention is its ability to adapt to any or all of the stated applications and those not yet defined. It is obvious that the present invention may be used as a single installation or as a plurality of such installations within a building or set of offices, etc. It is well known to interconnect smoke alarm devices wirelessly so that when one smoke alarm is activated, all of the units within the communications network are also activated so as to alert persons that are not near the initial detector. Likewise, plural units of the present invention may be linked in the same way so as to alert all occupants of intrusion, fire, or fume detection, and to provide for overall vigilance, music and intercom. It is well known to provide such networks of sensors in a building especially for fire and security uses. In like manner the present invention may be used in networks to advantage by wireless and wired connections. In FIG. 3 we show that components or units of the present invention may be provided with antennas for communication with other components or units, wirelessly. Although much of the technology of the present invention is well known in the art, the novelty of the present invention lies with the facilitation of mounting components near the rim of a recessed lighting fixture with the possibility of placement of components at a desired position by selecting a knockout to place the component with a field of view in a selected direction. The invention also provides a plurality of power outlets 20 for providing power to a selection of components for desired applications. Once the desired components are selected, they are inserted into the power outlets 20 and then mounted either on the shelf 22, for larger components, or on the mounting surface 13 for smaller components and sensors. This adaptability is highly novel in the field of this invention. The fixture further comprises means for networking the components with components of at least one further similar fixture. Such networking means may include any of the enablements defined in the following references devices including wireless communication channels and microprocessor or similar digital circuits capable of establishing communications links between devices within short distances of each other.

Arruda, U.S. 2006/0176697, discloses a combination light fixture and motion sensor apparatus contained in a single enclosure and is therefore hereby incorporated herein by reference for the details taught which are considered to be applicable to the enablement of the present invention. Norris, U.S. Pat. No. 4,090,178, discloses smoke detection circuitry in a wall or ceiling lamp apparatus and audible sound producing mechanism and defines circuitry for use of a rechargeable battery, and is therefore hereby incorporated herein by reference for the details taught which are considered to be applicable to the enablement of the present invention. Scripps, U.S. Pat. No. 4,694,285, discloses a combination electrical smoke, heat detector and electrical light in a single unit and a switching device to turn the light on or off, forms of which include: push button, toggle switch, or pull chain, is installed within the closed housing such that the switch is operable externally of the housing. A second switching device, also operable externally of the housing activates and de-activates a self-contained battery power source to operate the smoke and heat sensor functions of the combination. Therefore this teaching is hereby included herein by reference for the details taught which are considered to be applicable to the enablement of the present invention. Scripts et al., U.S. Pat. No. 4,717,910, discloses a detector and light assembly combining an electrically powered detector and alarm and an electrical light into a single unit and is therefore hereby included herein by reference for the details taught which are considered to be applicable to the enablement of the present invention. Lewkowicz, U.S. Pat. No. 4,896,145, discloses a combined light and fire detector fixture and is therefore hereby included herein by reference for the details taught which are considered to be applicable to the enablement of the present invention. Murphy, U.S. Pat. No. 4,980,672, discloses an overhead socket smoke detector with a theft alarm, and is therefore hereby included herein by reference for the details taught which are considered to be applicable to the enablement of the present invention. Sandell et al., U.S. Pat. No. 5,649,761, discloses a light fixture controlled by a passive infrared motion detector and is therefore hereby included herein by reference for the details taught which are considered to be applicable to the enablement of the present invention. Naqvi, U.S. Pat. No. 6,948,831, discloses a recessed lighting assembly that is adapted to be integrated with a motion detector and is therefore hereby included herein by reference for the details taught which are considered to be applicable to the enablement of the present invention. Loughrey, U.S. Pat. No. 6,960,892, discloses a light fixture and additional accessory control devices, such as motion sensors, photo sensors, and time clocks, and is therefore hereby included herein by reference for the details taught which are considered to be applicable to the enablement of the present invention.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings.

Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. A ceiling fixture comprising:

a vertically oriented cylindrical can having a lower open and terminating with a rim;

a mounting strap within the can supporting a lamp socket;

a lamp engaged with the lamp socket and depending downwardly therefrom;

a cylindrical lamp housing within the can, the lamp housing secured by, and depending downwardly from, the mounting strap, the lamp housing encircling at least a lower portion of the lamp;

a cylindrical mounting chassis integral with the lamp housing and extending downwardly therefrom, the mounting chassis positioned adjacent to the rim the mounting chassis having an annular mounting surface positioned at an angle of between 35 and 55 degrees relative to a vertical axis of symmetry of the can, a plurality of cutouts in the mounting surface are positioned therearound;

a motion detector positioned selectively and secured by one of the cutouts in the mounting surface, and thereby oriented with a line of sight directed aross the lower open end of the can at an angle of between 35 and 55 degrees with respect to the vertical axis of symmetry of the can.

2. The ceiling fixture of claim 1 further comprising an intercom including an audio receiver and an audio driver, the audio driver engaged with a loudspeaker for producing music, voice and alarm sounds.

3. The ceiling fixture of claim 1 wherein the lamp housing is secured to the mounting strap by at least one coil springs.

* * * * *